United States Patent [19]

Jost

[11] 4,456,474

[45] Jun. 26, 1984

[54] METHOD OF MAKING FINE SILVER POWDER

[75] Inventor: Ernest M. Jost, Plainville, Mass.

[73] Assignee: Chemet Corporation, Attleboro, Mass.

[21] Appl. No.: 491,806

[22] Filed: May 5, 1983

[51] Int. Cl.[3] ..... B22F 9/00

[52] U.S. Cl. ..... 75/0.5 A; 75/109

[58] Field of Search ..... 75/0.5 A, 109, 118 R, 75/118 P, 251

[56] References Cited

U.S. PATENT DOCUMENTS

| | | | |
|---|---|---|---|
| 2,796,343 | 6/1957 | Shaw et al. | 75/109 |
| 3,334,995 | 8/1967 | Gaspar | 75/118 R |
| 3,369,886 | 2/1968 | Metzger et al. | 75/0.5 |
| 3,390,981 | 7/1968 | Hoffman | 75/108 |
| 3,427,153 | 2/1969 | Venkatesan et al. | 75/108 |
| 3,620,713 | 11/1971 | Short | 75/0.5 A |
| 3,694,254 | 9/1972 | Blumenthal | 75/0.5 A |

FOREIGN PATENT DOCUMENTS

| | | | |
|---|---|---|---|
| 52-54661 | 5/1977 | Japan | 75/0.5 A |
| 1343004 | 1/1974 | United Kingdom | 75/0.5 A |

*Primary Examiner*—Michael L. Lewis

[57] ABSTRACT

Silver powder of high purity having a particle size within the range from 0.6 to 2.5 micrometers in diameter is made by providing a reaction mixture comprising a solution of hydrazine in deionized water containing excess ammonium hydroxide, spraying into the reaction mixture a solution of silver nitrate in deionized water, and adjusting concentrations and ratios of ingredients within limits to obtain a selected particle size within the range.

3 Claims, No Drawings

METHOD OF MAKING FINE SILVER POWDER

This invention relates to the manufacture of silver powder of high purity and of a particle size within the range 0.6 to 2.5 micrometers in diameter, and pertains more specifically to the reduction of aqueous silver nitrate solution by spraying it into a reaction mixture comprising hydrazine and excess ammonia under controlled conditions.

The reaction proceeds in accordance with the following equation:

$$AgNO_3+(NH_4)OH+\tfrac{1}{4}N_2H_4 \rightarrow Ag+(NH_4)NO_3+\tfrac{1}{2}N_2+2H_2O$$

The conditions under which the reaction is carried out are critical to obtaining the desired result.

The product is substantially free from alkali metals and from chloride and is highly uniform in particle size and surface area. It displays excellent sintering properties, exhibiting a density in the range from 93 to 97% of the theoretical (i.e., 9.8 to 10.2 grams per cc) when compressed at 5,000 psi and sintered at approximately 1650° F. It is therefore useful in electrical and electronic applications.

The process of the invention comprises providing a reaction mixture comprising a 0.2 to 11 molar hydrazine solution in deionized water containing ammonium hydroxide in which the mole ratio of ammonium hydroxide to hydrazine is in the range from 1:1 to 2:1, stirring the reaction mixture, spraying into said reaction mixture during stirring a silver nitrate solution in deionized water in the range of concentration from 1 to 8 molar, the mole ratio of silver nitrate to hydrazine being from 4:1 to 2:1, introducing into the reaction mixture or into the silver nitrate solution before the spraying step a dopant comprising a water-soluble copper salt in an amount equivalent to the range from 0 to 1000 ppm of copper by weight of silver, separating precipitated metal powder from the reaction mixture by filtration, washing the powder with deionized water, and drying it, the particle size of the powder produced being directly proportional within said range to an increase in said concentration of hydrazine and said ratio of ammonium hydroxide to hydrazine and to an increase in the concentration of said silver nitrate solution within the stated ranges, and being inversely proportional to an increase in the amount of dopant within said range.

As will be apparent from the foregoing, in the case of silver powders having a particle size near the upper end of the range, no dopant is needed, while a particle size near the lower end of the range requires an amount of dopant approaching the maximum. The water soluble copper salt used as dopant, such as copper nitrate or copper sulfate, must be free from chloride or other anion which forms an insoluble precipitate with silver. The dopant can be introduced into the reaction mixture either in advance of or simultaneously with the solution of silver nitrate.

The silver nitrate solution must be introduced in the form of a fine spray directed on to the surface of the liquid reaction mixture while the latter is being stirred.

The following specific examples are intended to illustrate more fully the nature of the invention without acting as a limitation upon its scope.

EXAMPLE 1

There were mixed together in a 240 gallon cylindrical reaction vessel having an inner diameter of 42 inches and equipped with a propeller type stirrer 10 inches in diameter driven at 325 rpm, 13.5 gallons of 6 molar aqueous ammonia solution (303 moles), 7.3 gallons of 3 molar aqueous hydrazine solution (83 moles), 42 grams of copper nitrate hexahydrate, and deionized water to a total of 200 gallons. After mixing for several minutes, there was sprayed onto the surface of the reaction mixture 38 gallons of a 2 molar solution of silver nitrate in deionized water. The silver nitrate solution was sprayed through a type HD nozzle (Spray Systems, Inc., Wheaton, Ill.) at a minimum pressure of 40 psi. Stirring was continued for approximately 30 to 40 minutes at room temperature, after which the silver powder product was separated from the reaction mixture by filtration on a Buchner industrial filter, washed with 150 gallons of deionized water, and dried in a vacuum oven. The product had a particle size of 0.6 micrometers diameter, surface area of approximately 2 square meters per gram, and a sinter density of 95% of the theoretical (9.97 grams per cubic centimeter) when cold pressed at 3000 psi and sintered at approximately 1650° F.

EXAMPLE 2

There were introduced into the same reaction vessel described in Example 1, 19 gallons of 6 molar aqueous ammonia solution (432 moles), 7.3 gallons of 3 molar aqueous hydrazine solution (83 moles), and sufficient deionized water to bring the total to 200 gallons. Stirring was conducted as described in Example 1. After stirring for a few minutes as described in Example 1, there was injected into the reaction mixture by spraying onto its surface, 12.7 gallons of a 6 molar solution of silver nitrate in deionized water. Stirring was continued at room temperature for 15 to 20 minutes after which the silver powder was separated by filtration on a Buchner industrial filter and washed with approximately 150 gallons of deionized water. The silver powder was then dried in a vacuum drier.

The product displayed a particle size of 2 micrometers in diameter, a surface area of approximately 0.6 square meter per gram and a density of 93% of the theoretical when pressed at 5000 psi and sintered at 1600° F. for ½ hour. The product contained less than 3 ppm of sodium, less than 1 ppm of potassium and less than 5 ppm of chloride.

By changing the concentrations and relative proportions of ingredients within the specified ranges any desired particle size within the range set forth above can be achieved. In the case of products having a particle size approaching the lower end of the range, it is desirable to include in the reaction mixture a surface active agent free from metal ions such as N,N',N'-tris(2-hydroxyethyl)-N-tallow-1,3-propanediamine (Ethoduomeen T/13) or ammonium salt of carboxylated polyelectrolyte (Daxad 32) in an appropriate amount, preferably no more than 1–2 parts per thousand of the reaction mixture.

The following table summarizes the effect upon the properties and characteristics of the product of changes in the various reaction conditions:

TABLE

Production Conditions To Achieve Silver Powders of Controlled Grain Size With The Ammonia Hydrazine Process. All Data are Applicable to a 1,000 oz. Silver

| Desired Particle Range Microns | Ammonia to Hydrazine Ratio | Copper Doping Level Weight ppm | $Ag\ NO_3$ Feed Concentration Mols/l | $Ag\ NO_3$ Feed Rate Minutes | Amount of Liquid in Reaction Vessel in Gallons | Surface Active Agent in Part Per Thousand |
|---|---|---|---|---|---|---|
| 0.6–0.8 | 1.05 | 500–1000 | 1–3 | 30–40 | 200–250 | 1–2 |
| 0.8–1.2 | 1.1 | 200–500 | 2–4 | 25–35 | 185–200 | 1–2 |
| 1.2–1.8 | 1.2 | 100–200 | 4–5 | 20–30 | 170–180 | [illegible] |
| 1.8–2.5 | 1.2–1.5 | 0 | 6–7 | 10–20 | 150–170 | 0 |

What is claimed is:

1. The method of making silver powder of high purity and of controlled particle size within the range 0.6 to 2.5 micrometers in diameter which comprises providing a reaction mixture comprising a 0.2 to 11 molar hydrazine solution in deionized water containing ammonium hydroxide in which the mole ratio of ammonium hydroxide to hydrazine is in the range from 1:1 to 2:1, stirring said reaction mixture, spraying into said reaction mixture during stirring a silver nitrate solution in deionized water in the range of concentration from 1 to 8 molar, the mole ratio of silver nitrate to hydrazine being from 4:1 to 2:1, introducing into said reaction mixture or into said silver nitrate solution before said spraying step a dopant comprising a water soluble copper salt in an amount equivalent to the range from 0 to 1000 ppm of copper by weight of silver, separating precipitated metal powder from said reaction mixture by filtration, washing said metal powder with deionized water, and drying said powder, the particle size of said powder being directly proportional within said range to an increase in said concentration of hydrazine and said ratio of ammonium hydroxide to hydrazine and to an increase in the concentration of said silver nitrate solution within said ranges, and being inversely proportional to an increase in the amount of dopant within said range.

2. The method as claimed in claim 1 in which there is introduced into said reaction mixture before said spraying step a surface active agent free from metal ions.

3. The method as claimed in claim 2 in which said surface active agent is selected from the group consisting of N,N',N'-tris(2-hydroxyethyl)-N-tallow-1,3-propanediamine and ammonium salt of carboxylated polyelectrolyte.

* * * * *